United States Patent [19]

Carlson

[11] Patent Number: 4,968,275

[45] Date of Patent: Nov. 6, 1990

[54] STABILIZER FOR A MOTOR BOAT

[76] Inventor: Harold C. Carlson, 5711 SW. 34th St., Ocala, Fla. 32674

[21] Appl. No.: 366,463

[22] Filed: Jun. 15, 1989

[51] Int. Cl.[5] ..... B63H 1/18

[52] U.S. Cl. ..... 440/66; 114/285

[58] Field of Search ..... 440/66, 53, 67; 114/281, 285, 288, 185

[56] References Cited

U.S. PATENT DOCUMENTS

| | | | |
|---|---|---|---|
| 2,748,742 | 6/1956 | Morris | 114/185 |
| 3,103,673 | 8/1962 | Martin, Jr. | 441/71 |
| 4,205,618 | 6/1980 | Olsson | 114/281 |
| 4,352,666 | 10/1982 | McGowan | 440/53 |
| 4,487,152 | 12/1984 | Larson | 440/66 |

OTHER PUBLICATIONS

Brochure by Atlantic Doel-Fin Inc. entitled "The Original" Doel-Fin Hydrofoil Planning Unit & Stabilizer.

Brochure by Marine Dynamics, Inc. entitled Sting Ray Hydrofoil Stabilizer.

Brochure by Grand Island Marine D&D entitled Turbo-Lift.

*Primary Examiner*—Joseph F. Peters, Jr.

*Assistant Examiner*—Jesus D. Sotelo

*Attorney, Agent, or Firm*—Banner, Birch, McKie & Beckett

[57] ABSTRACT

The present invention provides a stabilizer attached to the cavitation plate on the leg of a motor boat motor. Two elongated tubular members are attached by mounting brackets to the motor's cavitation plate. The tubular members are attached at a downward angle away from the boat so that an upward force is created by the hydrodynamic jet action of water flowing through the tubular members at the rear of the boat when the boat moves in a forward direction. The upward jet created force at the rear of the boat keeps the boat horizontal and stable at increasing speeds and at high speeds.

18 Claims, 4 Drawing Sheets

STABILIZER FOR A MOTOR BOAT

BACKGROUND OF THE INVENTION

1. Technical Field

The present invention relates to a stabilizer for a motor boat, and more particularly, to a motor mounted stabilizer for stablely maintaining the hull of the boat essentially parallel to the surface of the water.

2. Related Art

Motor boats experience performance problems due to the usual location of the motor at the rear (stern) of the boat, causing drag and and resulting in the front (bow) of the boat lifting out of the water. At high speeds, the lifting of the bow becomes more pronounced, blocking the view of the boat operator, and preventing safe steering of the boat. In an attempt to overcome this problem, many boat operators place passengers or other weight in the forward part of the boat so as to hold the bow down. However, the excess weight results in sluggish boat operation and reduced engine efficiency. Additionally, since a substantial part of the hull is out of the water, the boat tends to skip or slide during high speed turns.

A second performance problem occurring at high speed operation is known as "porpoising", that is, the tendency of the bow of the boat to oscillate between an extreme lifted position and a contact position with the water. This oscillation occurs rapidly, causing the bow to slam against the water surface, and then return to an extreme lifted position. "Porpoising" increases the difficulty of controlling the boat, as well as the roughness of the ride and passenger discomfort. Skipping or sliding during turns is also increased during "porpoising".

A third performance problem is experienced during acceleration from a stop. During acceleration, it is desirable to achieve "planing" mode, that is, when the flat surface of the hull is essentially in full contact with the water, as soon as possible. However, due to the above discussed tendency of the stern of the boat to sink beneath the surface of the water, causing the bow to be lifted out of the water during high-speed operation, planing of the boat during rapid acceleration is difficult or impossible to achieve. Thus, in order to obtain satisfactory acceleration, increased fuel consumption is required since the motor must operate at higher RPM to obtain high speed when a substantial part of the hull is out of the water.

One attempt to overcome the above problems is disclosed in Larson U.S. Pat. No. 4,487,152, which is directed to a boat stabilizer fitted over the cavitation plate on the motor post of the motor. The stabilizer is a generally delta wing shaped foil member and is attached at a position over the propeller to provide upward lift for the stern, apparently in the same manner as an airplane wing provides lift for the airplane as air rushes over it. However, in practice only limited success has been obtained with the wing stabilizer in eliminating the undesirable effect of "porpoising" at medium or high boat speeds. Furthermore, the wing-shaped stabilizer provides only minimal improvement in reducing skipping or sliding during turns.

SUMMARY OF THE INVENTION

It is an object of the present invention to provide a stabilizer for a motor boat which eliminates "porpoising" by maintaining the boat at a level plane with respect to the surface of the water, enabling safer and more efficient operation of the boat at medium and high boat speeds.

Another object of the present invention is to provide a stabilizer for a motor boat which allows the boat to achieve a level "plane" in a shorter time after the boat accelerates from a dead stop, and to maintain a level "plane" at a lower motor rpm.

Another object of the present invention is to provide a stabilizer for a motor boat which allows the boat to move at a higher speed when the engine operates at high rpm than when the motor operates at the same high rpm without the stabilizer.

Another object of the present invention is to provide a stabilizer for a motor boat which provides a more fuel efficient operation at all motor speeds and which allows the motor to be operated at a higher trimmed position at higher speeds.

Another object of the present invention is to provide a stabilizer for a motor boat which provides safer and more precise steering control during high speed turns, eliminating skidding and sliding, and which provides a tighter turning radius.

The present invention is directed to a motor boat stabilizer comprising a pair of hollow tubular members which are attached by a mounting bracket to the motor post of a boat motor. The motor housing includes an integrally formed cavitation plate disposed below the water line. The tubular members are attached on either side of the cavitation plate below the surface of the water and project rearwardly and downwardly. The tubular members are attached at an angle of between 10°-22° with respect to the plane of the cavitation plate, preferably at an angle of 20°. The tubular members are attached such that one end is adjacent a midpoint between the forward surface of the motor housing and the rear edge of the cavitation plate. The other ends extend approximately 7" beyond the rear edge of the cavitation plate. The tubular members may be made of stainless steel or any other suitable material. Three mounting arrangements are disclosed for attaching the tubular members to the cavitation plate such that the stabilizer may be adopted for different motor configurations.

Further object, features and other aspect of this invention will be understood from the detailed description of the preferred embodiments of the invention with reference to the drawings.

DETAILED DESCRIPTION OF THE INVENTION

Figure 1:
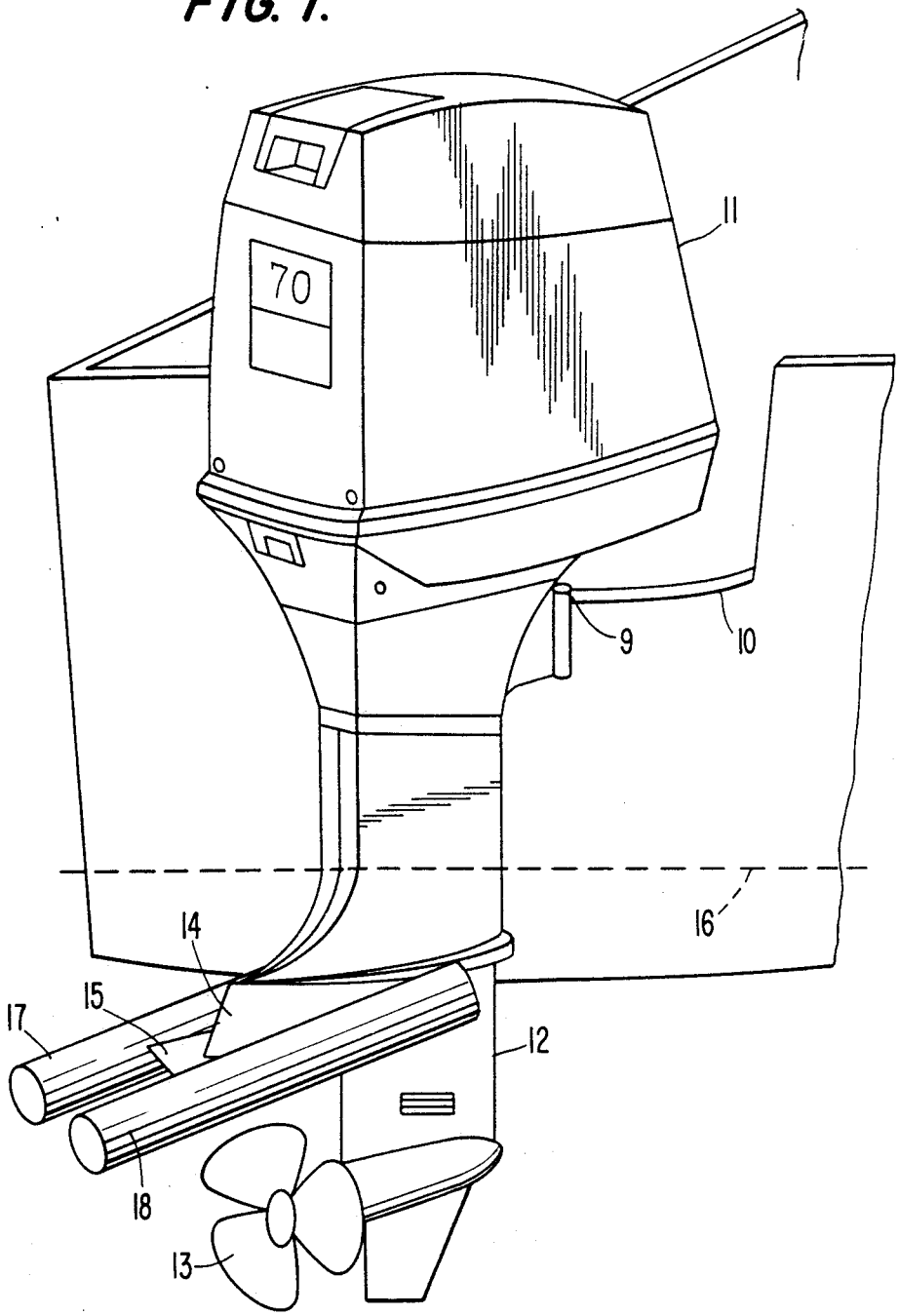
FIG. 1 is a perspective view of an outboard motor adapted with the tubular stabilizer of the present invention.

As shown in FIG. 1, motor 11 is disposed in a cut-out region of the upper part of boat hull 10. Motor 11 includes motor housing 14 which further includes motor post 12, and integrally formed essentially planar cavitation plate 15 projecting rearwardly therefrom. Propeller 13 is disposed on the lower part of motor post 12. Motor 11 is connected to hull 10 by pivot 9 such that motor 11 pivots about a substantially vertical axis to steer the boat. Additionally, although motor 11 is shown as an outboard motor, the invention may also be used with an inboard motor such that the stabilizer would be disposed on the hull at a position adjacent to propeller 13. Cavitation plate 15 is disposed below water line 16.

Stabilizer 20 includes hollow tubular members 17 and 18 disposed on either side of cavitation plate 15. The tubular members are attached to cavitation plate 15 and project rearwardly and below the cavitation plate at a downward angle. The angle between the rearwardly extending part of the tubular members and cavitation plate 15 is in a range between 10°-22°, and is preferably 20°. Tubular members 17 and 18 are disposed beneath water line 16. When cavitation plate 15 is disposed generally parallel to the surface of the water, tubular members 17 and 18 would be disposed beneath the surface at approximately a 20° angle with respect to the surface. Of course, if a power trimmer is used, the motor may be trimmed at various angles with respect to the transom, that is, the vertical rear surface of the hull. For example, the trim angle may vary between 16° out from the the transom (+16° with respect to the vertical plane), to 4° into the transom (−4°). Thus, although the angle of the tubular members with respect to the cavitation plate remains constant, the angle with respect to the surface will vary according to the trim angle of the motor.

Tubular members 17 and 18 may be constructed of stainless steel. However, other appropriate metallic or composite materials may be used to make the tubular members. The diameter of each tube is approximately 3"-3½", but may vary as necessary according to the size of the boat. For example, for a 60' yacht, the diameter may vary between 6"-8". Additionally, the length of tubular members 17 and 18 will vary according to the distance between the rear edge of the cavitation plate and the inboard side of motor post 12. In general, the length of the tubular members should be such that when the forward end of the tubular member is disposed approximately halfway between the rear end of the cavitation plate and the forward end of the motor post, the rearward end of the tubular members will extend for approximately 7" beyond the rear edge of the cavitation plate. In a typical 70 or 90 horse power motor, the motor measures 24" from the rear edge of the cavitation plate to the forward end, and the hollow tubular members should be $$(\tfrac{1}{2}\times 24'')+7''=19'',$$

in length. A typical 115 horsepower motor measures 30", and thus the tubular members should be 22" long.

Figure 2:
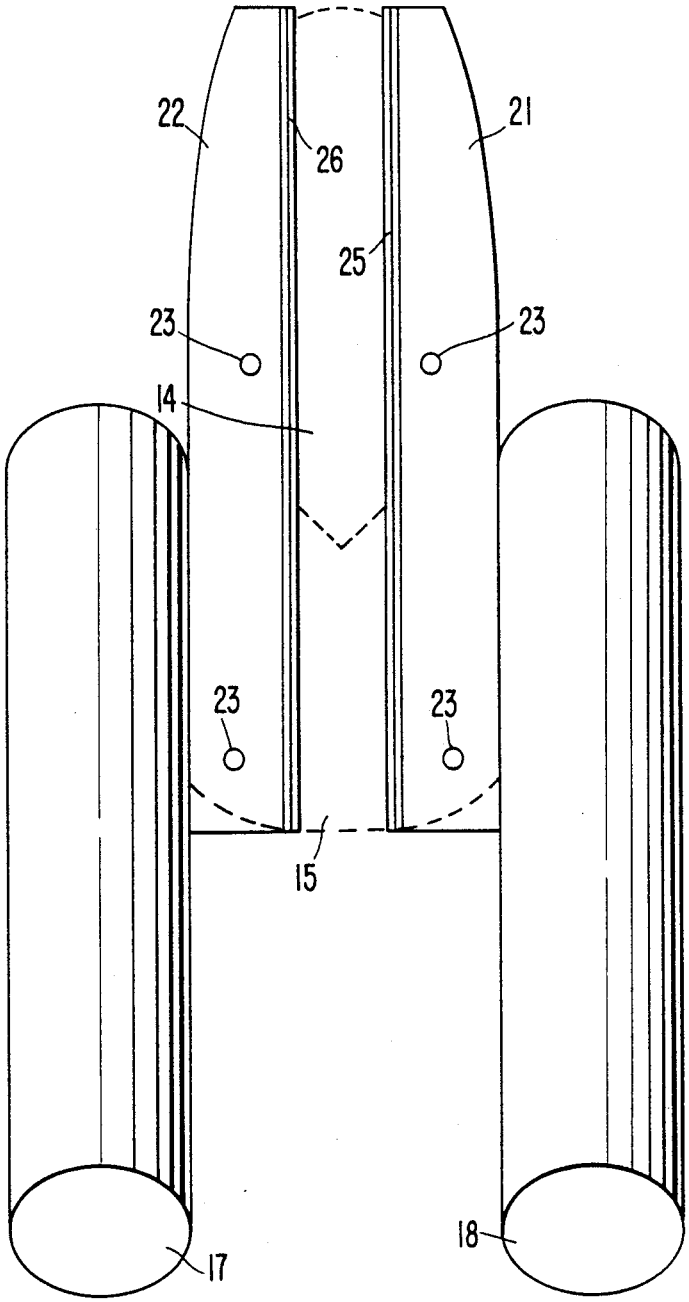
FIG. 2 is a view showing a first mounting arrangement of the tubular stabilizer of the present invention.
Figure 3:
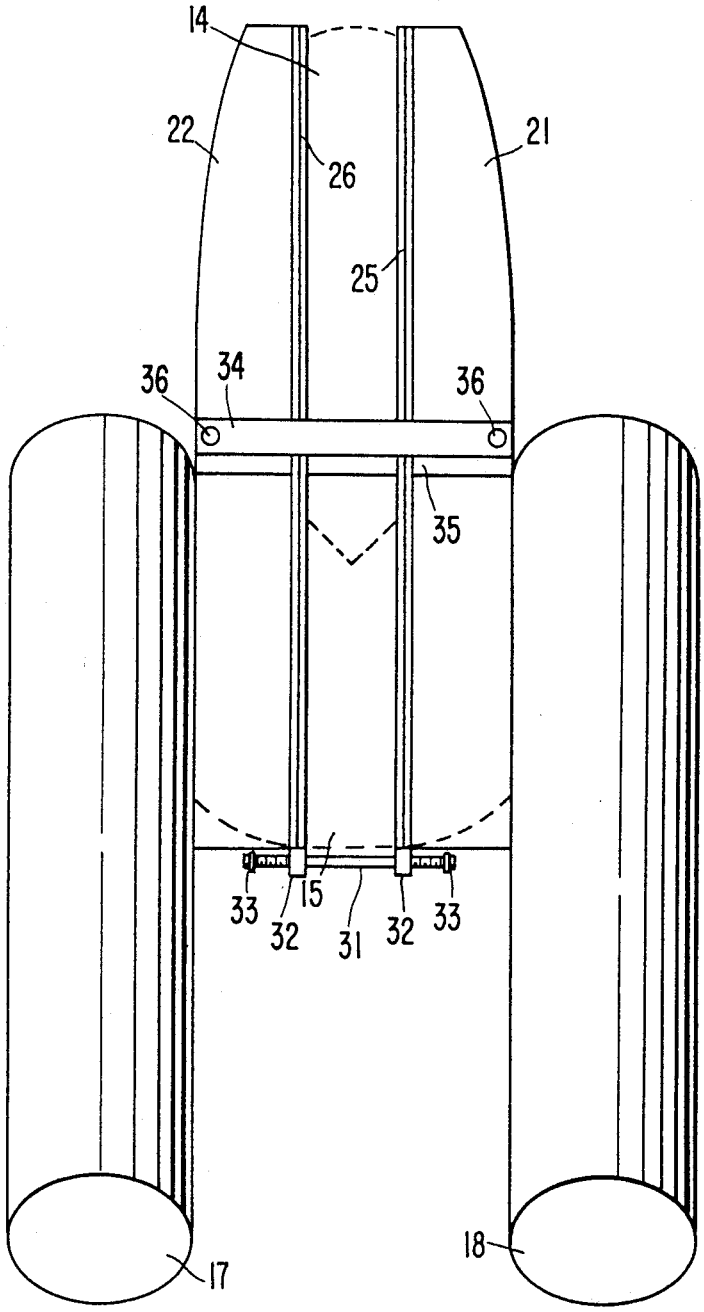
FIG. 3 is a view showing a second mounting arrangement of the tubular stabilizer of the present invention.
Figure 4:
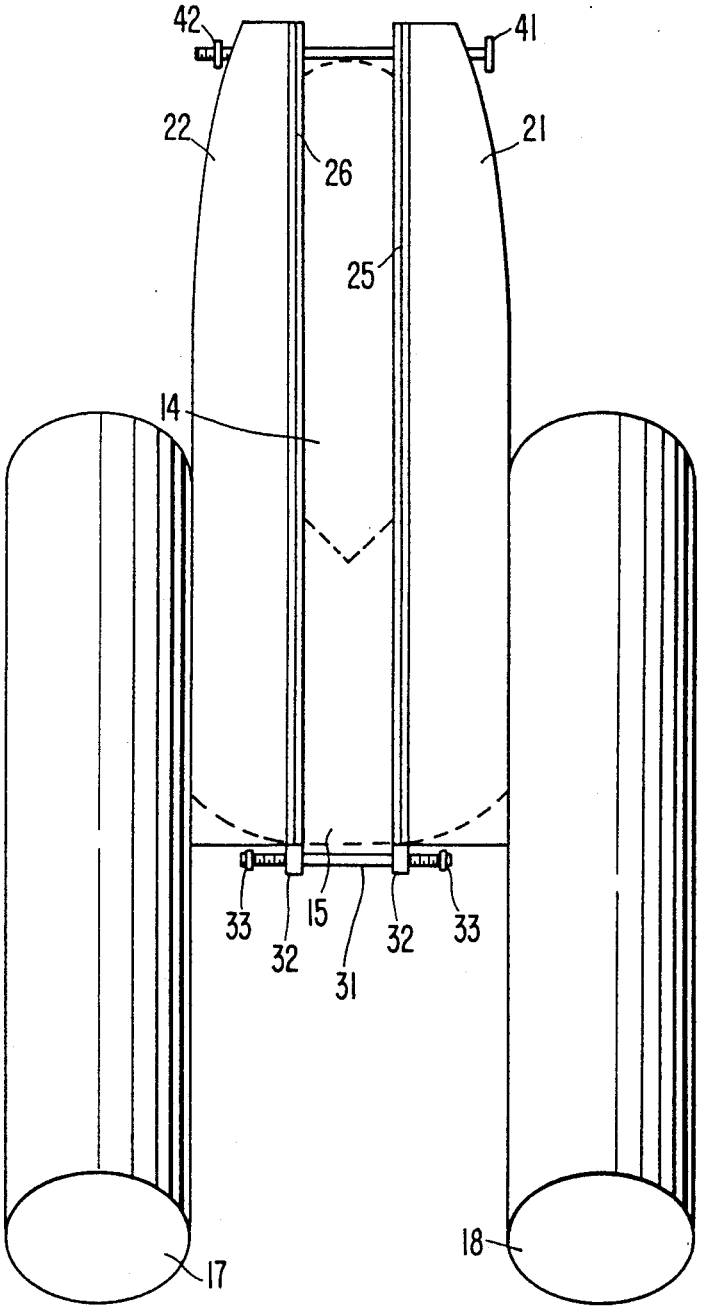
FIG. 4 is a view showing a third mounting arrangement for the tubular stabilizer of the present invention.

Three preferred mounting arrangements are disclosed, as shown in FIGS. 2-4. With respect to FIG. 2, tubular members 17 and 18 are fixedly attached to starboard (right side) mounting bracket 21 and port (left side) mounting bracket 22 by welding or other suitable means. Each bracket 21 and 22 includes recessed channels 25 and 26, respectively, formed on the inner surfaces. The recessed channels correspond to the lateral surfaces of cavitation plate 15. A plurality of holes 23 are disposed through brackets 21 and 22, and corresponding holes are disposed in cavitation plate 15. Each mounting bracket is disposed on the cavitation plate such that the lateral surfaces of the cavitation plate fit into corresponding recessed channels 25 and 26, and is fixed to the cavitation plate by bolts disposed through the holes.

With respect to FIG. 3, a second mounting arrangement is shown. Tubular members 17 and 18 are disposed on mounting brackets 21 and 22 as in the arrangement of FIG. 2. Brackets 21 and 22 are attached at their rearward ends by bolt 31 disposed through bolt guides 32 projecting from the rear surface of the brackets. Nuts 33 are disposed on opposite ends of bolt 31 to secure the brackets at one end. The brackets are disposed on cavitation plate 15 as in FIG. 2.

The motor housing of the motor for which the second mounting arrangement is designed to be used includes an upper water cooling passage (not shown) which is essentially a hole disposed through the motor housing at a position above the cavitation plate. Upper strap 34 is disposed through the hole. Lower strap 35 is disposed beneath and immediately adjacent the cavitation plate. The straps are aligned with each other and are preferably ½ inch wide. The upper and lower straps are secured to brackets 21 and 22 by a single bolt 36 disposed through each end of the straps and through the corresponding bracket. The provision of the strap through the water cooling passage and the lower strap adjacent the cavitation plate securely maintains the stabilizater on the motor.

A third mounting arrangement is shown in FIG. 4. The tubular members and mounting brackets are similar to those shown in FIG. 2. Additionally, the third arrangement includes bolt guides 32, bolt 31 and nuts 33 on the rearward end of the mounting brackets as disclosed in FIG. 3. Furthermore, forward holes are disposed through the forward ends of brackets 21 and 22, in a direction substantially parallel to their horizontal surfaces. Bolt 41 is disposed through the forward holes, and is disposed at a location between the forward surface of motor post 12 and rearward of the stern. Nut 42 is disposed on bolt 41 to a securely retain bolt 41 in the holes, and to securely retain the mounting bracket and tubular member assembly on the cavitation plate. No holes need be drilled in cavitation plate 15 in the third mounting arrangement.

In operation of the boat, water enters the tubular members at the forward end, flows through the hollow tubular members, and is emitted at the rear end as a jetstream, thereby creating an upward force on the motor housing and thus the stern of the boat, urging the bow of the boat downwardly. Thus, undesirable "porpoising" is substantially eliminated. Additionally, the downward force acting on the bow causes the boat to "plane" much faster after starting from a stop. Increased control of the boat during high-speed turns is obtained, and skipping, slipping and skidding is significantly reduced. The turning radius of the boat is also reduced. Cavitation, that is, the tendency for air pockets to be formed in the water about the propeller and reducing the propulsion efficiency, is also reduced. The rounded design of the tubular members and the smoothness of the mounting brackets result in minimal resistance to movement through the water. All of the above advantages further result in increased efficiency of operation of the motor such that the boat moves at a higher speed for a given horsepower output of the motor. Thus, the boat may be operated at the same speed as without the stabilizer, with a corresponding increase in fuel efficiency since more of the horsepower of the motor goes into forward propulsion of the boat, rather than into undesirable "porpoising". Finally, the stabilizer of the present invention substantially reduces the risk that the boat will become substantially airborne during high speed operation.

This invention has been illustrated and described in connection with the preferred embodiments. These embodiments, however, are merely for example only and the invention is not restricted thereto. It will be understood by those skilled in the art that other variations and modifications can easily be made within within the scope of this invention as defined by the appended claims.

I claim:

1. A stabilizer for a motor boat having a stern mounted motor, said motor including a motor housing comprising a motor post, a propeller mounted on the motor post and driven by the motor, and a cavitation plate disposed on the motor post at a location below the waterline, said stabilizer comprising:

at least one pair of hollow tubular members, each said tubular member mounted on opposite sides of said motor post and disposed below the waterline; and mounting means for mounting said tubular members on said motor post below the waterline, said tubular members projecting rearwardly from and beyond said motor post at a downward angle with respect to the surface of the water.

2. The stabilizer of claim 1, said mounting means disposed on said cavitation plate, said tubular members projecting rearwardly from said cavitation plate and disposed at a downward angle with respect to said cavitation plate.

3. The stabilizer of claim 2, wherein said downward angle is in the range of 10°–22°.

4. The stabilizer of claim 3, wherein said downward angle is 20°.

5. The stabilizer of claim 2, said mounting means comprising a pair of mounting brackets, each tubular member disposed on one said bracket.

6. The stabilizer of claim 5, said mounting brackets including grooves disposed therein and corresponding to lateral surfaces of said cavitation plate, said mounting brackets disposed on opposite sides of said cavitation plate at said grooves.

7. The stabilizer of claim 6, said mounting brackets including holes disposed therein, said cavitation plate including corresponding holes disposed therein, said mounting brackets secured to said cavitation plate by bolts disposed through said holes.

8. The stabilizer of claim 6, said mounting brackets linked at an end rearward of said motor post by a bolt, said motor housing including a hole disposed therethrough, a first strap disposed through said hole, a second strap disposed beneath said cavitation plate, said first and second straps disposed substantially aligned with each other, said straps secured to said mounting brackets by a single bolt disposed through each side of said straps and through a corresponding bracket to secure said brackets to each other and to said motor post.

9. The stabilizer of claim 6, said mounting brackets linked at a rearward end by a first bolt disposed rearward of said motor post, said mounting brackets linked at a forward end by a second bolt disposed between said motor post and the hull of said boat, said second bolt disposed through holes in the forward end of said brackets.

10. The stabilizer of claim 1, each said tubular member having a diameter of between 3″–3½″.

11. The stabilizer of claim 1, each said tubular member having a diameter of between 6″–8″.

12. The stabilizer of claim 1, said tubular members each having a length substantially equal to one-half of the length of said motor plus 7″, said length measured between the rear end of said cavitation plate and a forward surface of said motor post, said tubular members disposed such that they extend rearwardly of said cavitation plate by said 7″.

13. A motor for a motor boat comprising: a motor housing including a motor post, a propeller mounted on said motor post and driven by said motor, a plurality of hollow tubular members connected to said motor post below the water line, each said tubular member having first and second open ends, said tubular members disposed laterally of said motor post and projecting rearwardly and downwardly away from said motor post.

14. The motor of claim 13, further comprising mounting brackets for connecting said tubular members to said motor post.

15. The motor of claim 14, further comprising a cavitation plate projecting rearwardly from and formed integrally with said motor post.

16. The motor of claim 15, said mounting brackets connected to said cavitation plate, said tubular members disposed at a downward angle with respect to said cavitation plate.

17. An improved motor boat comprising: a boat hull having a bow and a stern, a propeller for propelling said boat, a motor linked to said propeller for powering said propeller, and at least one pair of hollow tubular members mounted laterally of said propellor at a downward angle with respect to a plane containing said propellor, wherein, movement of the boat through the water creates a jetstream of water flow through said tubular members such that said jetstream creates a downward force on said bow to hold said boat horizontally in the water.

18. The motor boat of claim 17, said motor further comprising a cavitation plate, said tubular members disposed on either side of said cavitation plate at a downward angle of about 10°–22° with respect thereto.

* * * * *